US006412160B1

(12) United States Patent
Glessner et al.

(10) Patent No.: US 6,412,160 B1
(45) Date of Patent: Jul. 2, 2002

(54) SWAGED TUBE FITTING COLLAR AND DIE

(75) Inventors: John Carl Glessner, Kings Mills, OH (US); Norman Stanton Baylis, Salem, NH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/668,909

(22) Filed: Sep. 22, 2000

(51) Int. Cl.[7] ..... B23P 17/00; B21D 41/02

(52) U.S. Cl. ..... 29/423; 29/282; 29/283.5; 29/437; 29/505; 72/316; 72/318

(58) Field of Search ..... 29/423, 437, 505, 29/515, 516, 520, 522.1, 523, 282, 283.5, 243.517; 72/316, 317, 318, 357, 293.7, 298

(56) References Cited

U.S. PATENT DOCUMENTS

| | | | | | |
|---|---|---|---|---|---|
| 2,381,747 | A | * | 8/1945 | Howe | 29/282 |
| 2,972,186 | A | * | 2/1961 | Howe | 29/516 |
| 3,019,520 | A | * | 2/1962 | Woolley | 29/234 |
| 3,115,797 | A | * | 12/1963 | Howe | 29/282 |
| 3,230,754 | A | * | 1/1966 | Arbogast | 72/316 |
| 3,244,441 | A | * | 4/1966 | Caudle | 285/374 |
| 3,252,192 | A | * | 5/1966 | Smith | 269/117 |
| 3,503,244 | A | * | 3/1970 | Joslin | 72/317 |
| 3,724,053 | A | * | 4/1973 | Finkel et al. | 29/823 |
| 3,803,897 | A | * | 4/1974 | Ridenour et al. | 72/412 |
| 3,838,591 | A | * | 10/1974 | Ross | 72/318 |
| 3,848,451 | A | * | 11/1974 | Allin | 72/402 |
| 3,956,815 | A | * | 5/1976 | Capper et al. | 29/421.2 |
| 3,959,998 | A | * | 6/1976 | Ross | 72/312 |
| 4,362,042 | A | * | 12/1982 | Crow, Jr. | 72/359 |
| 4,418,458 | A | * | 12/1983 | Hunter | 29/237 |
| 5,040,396 | A | * | 8/1991 | Mikhail et al. | 72/117 |
| 5,056,208 | A | * | 10/1991 | Stafford | 29/515 |
| 5,454,152 | A | * | 10/1995 | Hosseinian | 29/243.518 |
| 5,776,519 | A | * | 7/1998 | Flammer | 425/188 |
| 6,199,254 | B1 | * | 3/2001 | Suresh | 29/237 |

* cited by examiner

*Primary Examiner*—S. Thomas Hughes
*Assistant Examiner*—Essama Omgba
(74) *Attorney, Agent, or Firm*—Nathan D. Herkamp; Pierce Atwood

(57) ABSTRACT

An assembly for retaining a work piece and fitting together for placement in a swage machine. The assembly includes a die and a collar to keep the work piece from moving during the swaging process. The collar includes two clamping sections that are connected together, such as by a hinge. The collar is placed about the work piece and then clamped in place by a retaining bolt at the opposing end of the clamping sections. The die includes a recess for holding the collar and a recess for the tube. The assembly includes an anti-rotation feature to minimize rotation of the collar within the recess. One example of an anti-rotation feature is the formation of the recess and the collar in corresponding hexagonal shapes. The die may also include a recess for retaining a fitting to be swaged to the work piece. The die and collar assembly eliminates the need for nylon inserts and eliminates work piece rotation and axial movement during the automated swaging process.

15 Claims, 3 Drawing Sheets

SWAGED TUBE FITTING COLLAR AND DIE

BACKGROUND OF THE INVENTION

This invention relates generally to swage machines and more particularly to collars and dies used to retain tubes in such machines during the swaging process.

Swaging involves the tapering of a rod or tube, such as by forging, hammering, or squeezing. It may also involve the joining together of two components by similar manipulation. For example, a fitting, just as a coupling, may be joined to the exterior of a tube by any of the operations of forging, hammering or squeezing. In general, the fitting is placed on the outside of the rod or tube and then swaged into place, preferably substantially where located. Swaging is a common practice for applying fittings to tubes. A plurality of tubes may be joined together by way of their fitting connections that have been swaged to either or both ends of the tubes.

Although swaging may be performed manually, swage machines are used to automate and facilitate the process of swaging a fitting to a tube. A wide array of swaging machines is available. Most include means for retaining one or more dies. A die retains the fitting and tube in place during the swaging process. With the fitting and tube in place in the die, pressure is applied to the exterior of the fitting where it is in contact with the exterior of the tube. This is achieved either by rotating the piece, tube, rod, or the like, to be worked or by rotating swaging devices about the piece that remains in a fixed position. The pressure applied to a tube work piece may alternatively be made from the interior of the tube by way of an expander. This is referred to as internal roller swaging.

In most instances, the fitting is larger than the tube. Given the proximity of the two within a die or set of dies, it is necessary to include means to capture the tube within the die to keep it fixed in place during the swaging process. Such means is a tight-fit annular insert that is placed around the tube and resides in a recess in the die. The insert is generally made of a non-metallic material, such as nylon. The nylon insert wedges the tube in place within the die. For internal roller swaging, a set of opposing die halves is used to position the fitting and tube. Each half includes a half-annular nylon insert. The tube and fitting are placed in one of the halves and then clamped in place when the second die half is mated to the first.

It has been determined that the nylon insert is inadequate to retain the tube in place during the swaging process. Specifically, because the insert is made of a viscoelastic material, it often fails to provide adequate clamping force during the rigorous swaging process. As a result, the tube rotates and/or moves axially during the process. In addition, the amount of clamping force associated with the die set is dependent on individual die tolerances and die wear when using the nylon inserts. It is therefore often necessary for an operator to hold the tube in place to prevent rotation and axial movement. This limits the efficiency of the automated swaging process, minmizes the operator's ability to perform other tasks, and increases the yield of defective parts. Therefore, what is needed is a die and die-to-tube interface arrangement that retain the tube and fitting in place with certainty during swaging.

SUMMARY OF THE INVENTION

The above-mentioned need is met by the present invention, which provides a die and collar assembly for retaining a tube and its fitting in place in a swage machine.

The assembly includes a collar releasably placeable on the work piece and a die insertable into the swage machine. The die includes a work piece slot and a collar recess in a die face of the die. The collar recess is configured to retain the collar that in turn is coupled about the work piece. The collar includes a first clamping section and a second clamping section that are connected together during the swaging process. For curved work pieces, the collar includes in one of its faces a chamfered section to accommodate the curved portion of the work piece. The collar recess and the collar may be of hexagonal shape. When a fitting is to be swaged to the work piece, a fitting recess is formed in the die face. In addition, a dummy fitting may be used to fix the position of the collar on the work piece before swaging a final fitting.

The present invention and its advantages over the prior art will become apparent upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
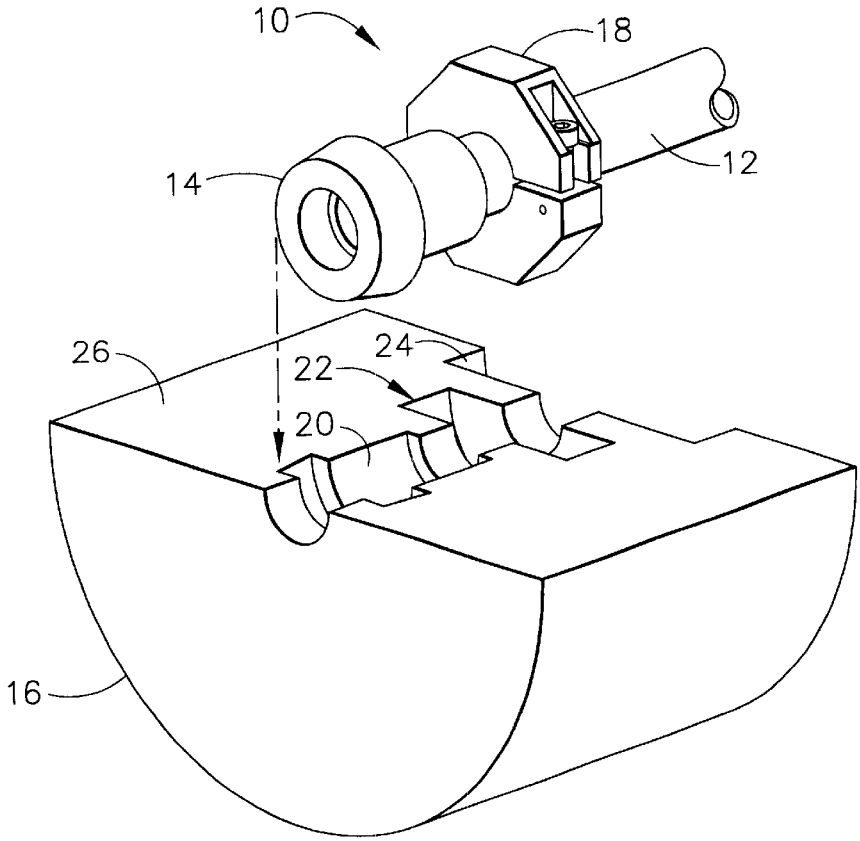
FIG. 1 is a perspective view of a first embodiment of the die and collar assembly of the present invention, showing one of a mirror-image pair of dies and a tube with fitting and collar thereon.
Figure 2:
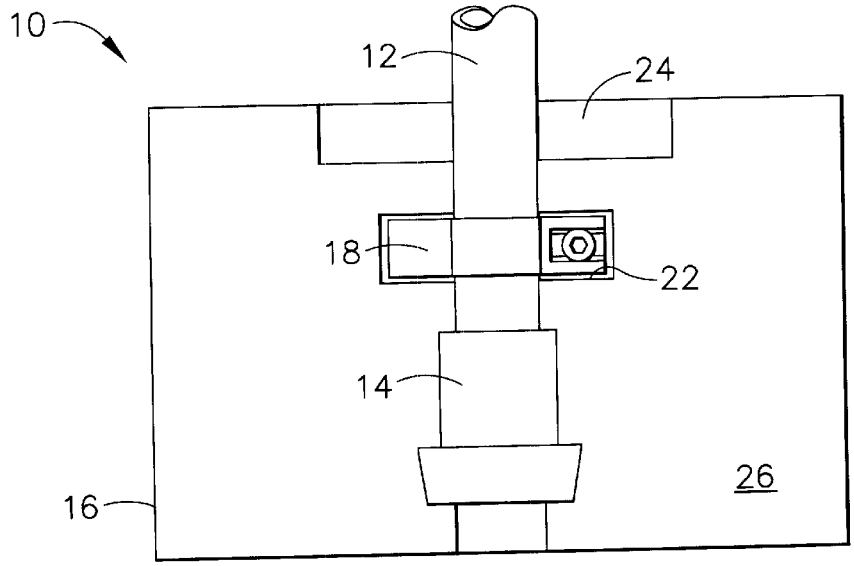
FIG. 2 is a top view of the die section of FIG. 1 with the tube, fitting and collar in place.

Referring to the drawings wherein identical reference numerals denote the same elements, FIGS. 1 and 2 illustrate a first die-and-collar assembly 10 that may be used in a swaging machine to swage a work piece, such as tube 12, and a fitting 14. The assembly 10 includes a die 16 and a collar 18 that in combination retain the tube 12 and fitting 14 in place during swaging. The die includes a fitting recess 20, a collar recess 22, and a tube slot 24 in a die retaining face 26.

Figure 3:
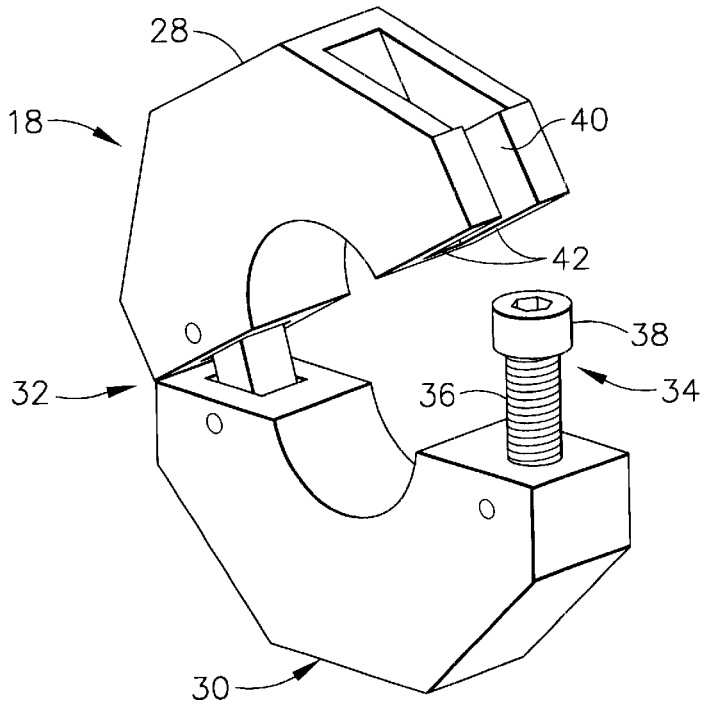
FIG. 3 is a perspective view of the collar of the first embodiment of the present invention shown partially open.

The fitting recess 20 and the tube slot 24 may be sized to accommodate the particular dimensions of the fitting 14 and the tube 12. The collar 18 is formed in a configuration that minimizes the opportunity for it to spin within the collar recess 22 when the swaging operation occurs. Although many rotation-prevention configurations are possible, one approach is to form the collar recess 22 in a hex in shape. For that shape, the collar 18 could also be hex shape, as shown in FIGS. 1 and 3. Of course, other types of "anti-rotation"

features may form part of the collar 18 and/or the recess 22. One example may be the introduction of a set screw.

With continuing reference to FIGS. 1–3, the collar recess 22 has dimensions exceeding the outer dimensions of the collar 18. There may be a slight gap between the sidewalls of the collar recess 22 and the collar 18 when the collar is in place in the collar recess 22. The slight gap permits easy insertion and removal of the collar 18 when applied to the tube 12 as shown in FIG. 1. However, that gap is not to be so large as to permit significant fore and aft movement of the collar 18 in the die 16.

The die 16 and the collar 18 may be formed of any material suitable for swaging work pieces. The die 16 and collar 18 may both be made of a similar material, such as steel. Either or both components may alternatively be fabricated of other suitable materials including, but not limited to, Aluminum, stainless steel, Titanium, or Nickel alloys. The collar 18 shown in FIG. 3 includes a first clamping section 28 and a second clamping section 30. The first clamping section 28 and the second clamping section 30 are connected together by a hinge 32. The second clamping section 30 includes in a collar face a collar clasp or collar retainer such as a capture bolt 34. The capture bolt 34 includes a bolt body 36 and a bolt head 38. The bolt body 36 is designed to fit within a collar slot 40 of the first clamping section 28. The collar slot 40 includes retaining prongs 42 against which the bolt head 38 resides when a work piece is disposed between sections 28 and 30. The bolt head 38 may be slotted or have similar tightening means such that when tightened onto the prongs 42, the work piece remains fixed in place. The hinge 32 provides an easy means for keeping sections 28 and 30 together while making insertion and removal of the work piece simple. The collar may alternatively be formed of two separate sections not hingedly connected together. Instead, the two separate sections may be coupled together by alternative collar attachment means, such as a set of threaded bolts and corresponding nuts, among other common attachment options.

The die-and-collar assembly 10 of FIGS. 1–3 enables secure placement of a work piece, such as tube 12, into a swaging machine. It eliminates the problems associated with use of the nylon insertion. In particular, it prevents work piece rotation and fore and aft movement of the work piece. It eliminates the need to have an operator manually hold the work piece in place during the swaging operation. In addition, a "dummy" fitting may be employed prior to insertion of the work piece in the die 16. The dummy fitting, essentially a fitting of the type to be swaged, may be placed in the appropriate position on the tube 12. The collar 18 may then be fixed in place on the tube 12. This procedure may be completed prior to initiating the swaging process. The fitting to be swaged and the tube 12 with the collar 18 fixed in place are then inserted into the appropriate recesses in the die face 26. The swage machine may then be operated and with the collar 18 in the appropriate position, accurate setback of the fitting 14 on the tube 12 is assured. Sensitivity of the process to roller wear and die tolerance variations is also eliminated.

Figure 4:
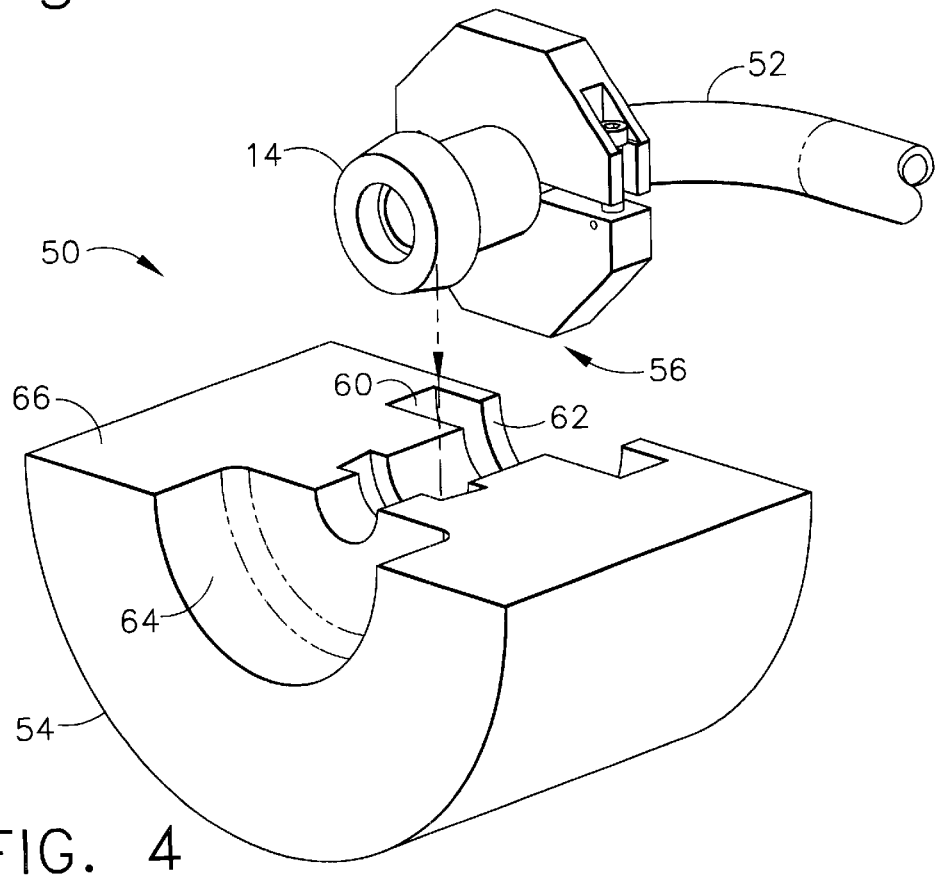
FIG. 4 is a perspective view of a second embodiment of the die and collar assembly of the present invention, showing one of a mirror-image pair of dies and a tube with fitting and collar thereon.
Figure 5:
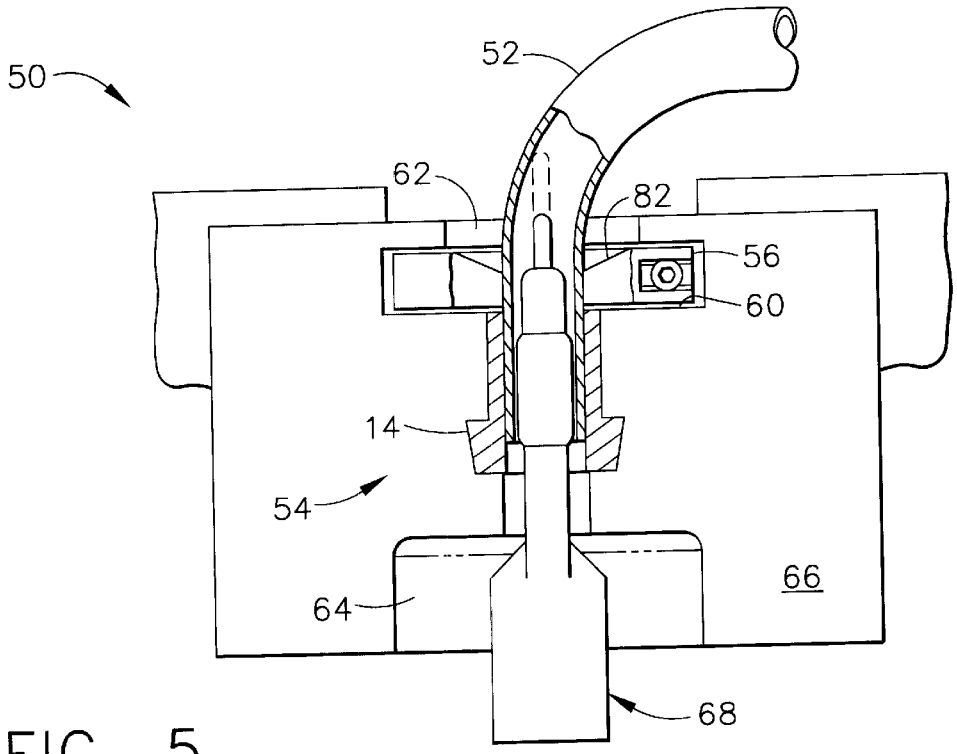
FIG. 5 is a top view of the die section of FIG. 4 with the tube, fitting and collar in place.
Figure 6:
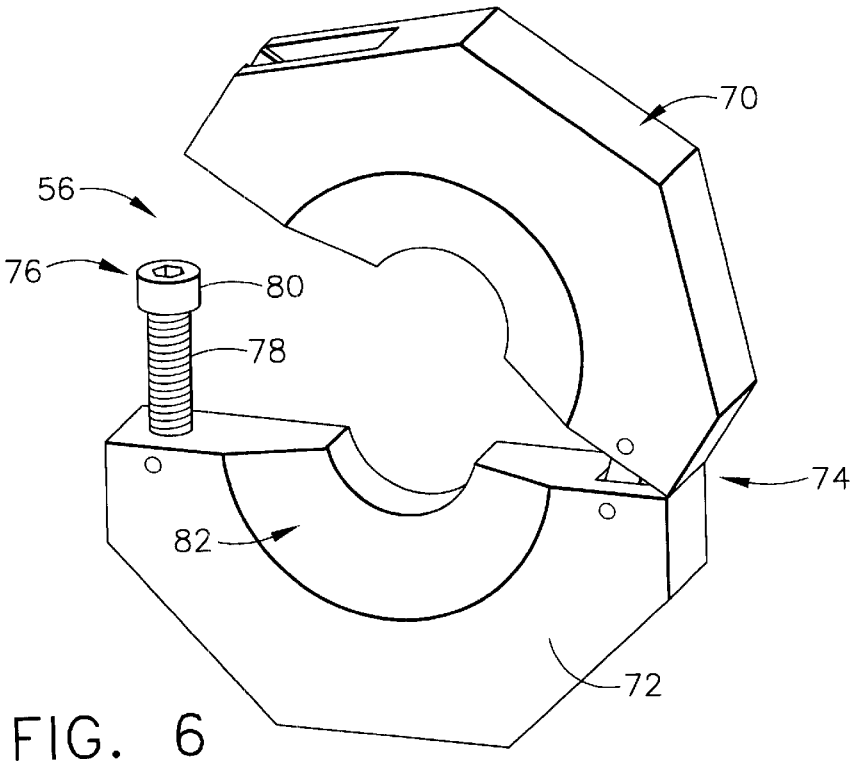
FIG. 6 is a perspective view of the collar of the second embodiment of the present invention shown partially open and with chamfer to accept short-straight-length tube for swaging.

The assembly 10 of FIGS. 1–3 is suitable for retaining a work piece such as tube 12 that has a "long" straight length. However, it may not be suitable for work pieces having "short" straight lengths in relation to the location of the fitting to be swaged. FIGS. 4–6 illustrate a second embodiment of the present invention suitable for work pieces of short straight length. A second die-and-collar assembly 50 may be used in a swaging machine to swage a short piece, such as curved tube 52, and a fitting 14. The assembly 50 includes a die 54 and a collar 56 that in combination retain the tube 52 and fitting 14 in place during swaging. The die includes a fitting recess 58, a collar recess 60, and a chamfered tube slot 62 and an optional expander port 64 in a die retaining face 66.

The fitting recess 58 may be sized to accommodate the particular dimensions of the fitting 14. The chamfered tube slot 62 allows for the insertion of tubes having very short straight sections into the die 54 without impact on the curved portion of the tube 52 that is not held in the die 54. The die 54 may also include port 64 to permit insertion of an expander 68 if the tube 52 is to be expanded in the region where the fitting 14 is to be located.

The collar 56 is formed in a configuration that minimizes the opportunity for it to spin within the collar recess 60 when the swaging operation occurs. Although many rotation-prevention configurations are possible, one approach is to form the collar recess 60 in a hex shape. For that shape, the collar 56 could also be hex shape, as shown in FIGS. 4 and 6. The collar recess 60 has dimensions exceeding the outer dimensions of the collar 56. There may be a slight gap between the sidewalls of the collar recess 60 and the collar 56 when the collar is in place in the collar recess 60. The slight gap permits easy insertion and removal of the collar 56 when applied to the tube 52 as shown in FIG. 4. However, that gap is not to be so large as to permit significant fore and aft movement of the collar 56 in the die 54.

The die 54 and the collar 56 may be formed of any material suitable for swaging work pieces. The die 54 and collar 56 may both be made of a similar material, such as steel. Either or both components may alternatively be fabricated of other suitable materials including, but not limited to, Aluminum, stainless steel, Titanium, or Nickel alloys. The collar 56 shown in FIG. 6 includes a first clamping section 70 and a second clamping section 72. The first clamping section 70 and the second clamping section 72 are connected together by a hinge 74. The second clamping section 72 includes in a collar face a collar clasp or collar retainer such as a capture bolt 76. The capture bolt 76 includes a bolt body 78 and a bolt head 80. The bolt body 78 is designed to fit within a collar slot substantially the same as the arrangement and clamping mechanism of collar 18 of FIG. 3. The hinge 74 provides an easy means for keeping sections 70 and 72 together while making insertion and removal of the work piece simple. In order to accommodate the curve of the tube 52, the second clamping section 72 includes a chamfer or recess 82 in its vertical face closest to the curve.

The die-and-collar assembly 50 of FIGS. 4–6 enables secure placement of a work piece having a short straight length, such as tube 52, into a swaging machine. It eliminates the problems associated with use of the nylon insertion. In particular, it prevents rotation and fore and aft movement of the curved work piece. It eliminates the need to have an operator manually hold the work piece in place during the swaging operation, which may be particularly difficult for curved work pieces. As with assembly 10, a "dummy" fitting may be employed prior to insertion of the work piece in the die 54. The dummy fitting, essentially a fitting of the type to be swaged, may be placed in the appropriate position on the tube 52. The collar 56 may then be fixed in place on the tube 52. This procedure may be completed prior to initiating the swaging process. The fitting to be swaged and the tube 52 with the collar 56 fixed in place are then inserted into the appropriate recesses in the die face 66. The swage machine may then be operated and with the collar 56 in the appropriate position, accurate setback of the fitting 14 on the tube 52 is assured. Sensitivity of the process to roller wear and die tolerance variations is also eliminated.

The foregoing has described an improved die-and-collar assembly. While specific embodiments of the present invention have been described, it will be apparent to those skilled in the art that various modifications thereto can be made without departing from the spirit and scope of the invention as defined in the appended claims.

What is claimed is:

1. A swage die and collar assembly for retaining a work piece in a swage machine, the assembly comprising:

a collar releasably placeable on the work piece, said collar including a first clamping section and a second clamping section hingedly connected together; and a die insertable into the swage machine, said die including a work piece slot and a collar recess in a die face thereof, wherein said collar recess is configured to hold said collar therein.

2. The assembly of claim 1 wherein said second clamping section includes a clamping bolt for releasably clamping said collar about the work piece, wherein said clamping bolt joins said first clamping section and said second clamping section.

3. The assembly of claim 1 wherein the work piece is a curved work piece and said second clamping section of said collar includes a chamfered facing and said die includes a chamfered work piece port.

4. The assembly of claim 1 further comprising an anti-rotation feature such that said collar does not rotate within said collar recess.

5. The assembly of claim 1 wherein said die face further includes a fitting recess for retaining a fitting therein.

6. The assembly of claim 1 wherein the work piece is a tube, said die face further including an expander port for receiving an expander therein.

7. A method for swaging a work piece in a swage machine, the method comprising the steps of:

applying a collar about the work piece at a selectable position, wherein said collar includes a first clamping section and a second clamping section hingedly connected together;

tightening said collar about the work piece;

inserting said collar and the work piece in a collar recess and a work piece slot, respectively, of a die; and inserting said die with said collar and the work piece into the swage machine.

8. The method of claim 7 further comprising before the step of applying said collar about the work piece the step of placing a dummy fitting on the work piece in a selectable position and after applying and tightening said collar, removing said dummy fitting and applying to the work piece a fitting to be swaged to the work piece.

9. The method of claim 7 further comprising the step of forming a fitting recess in said die face for receiving therein a fitting to be swaged to the work piece.

10. The method of claim 7 wherein the work piece is a tube, further comprising the step of forming an expander port in said die face of said die.

11. The method of claim 10 further comprising the step of forming a chamfer in a face of said second clamping section.

12. The method of claim 11 further comprising the step of forming a chamfered tube port in said die face of said die.

13. The method of claim 7 wherein said collar recess and said collar are of hexagonal shape.

14. A die assembly for retaining a work piece in a swage machine, comprising:

a die having first and second die halves, each of said die halves including a work piece slot and a collar recess for receiving a collar;

a collar having first and second clamping sections and means for attaching said first and second sections around said work piece, wherein at least one of said collar and said collar recess include a feature to prevent relative rotation of said collar and said die when said collar is disposed in said collar recess.

15. The die assembly of claim 14 wherein said collar recess and said collar are of hexagonal shape.

* * * * *